US005383559A

United States Patent [19]

Toren

[11] Patent Number: 5,383,559

[45] Date of Patent: Jan. 24, 1995

[54] DISPENSING CONTAINER FOR TABLETS

[75] Inventor: Thomas Toren, Bondi, Australia

[73] Assignee: Toren Consulting Pty Limited, Bondi, Australia

[21] Appl. No.: 242,065

[22] PCT Filed: May 29, 1991

[86] PCT No.: PCT/AU91/00233

§ 371 Date: Feb. 2, 1993

§ 102(e) Date: Feb. 2, 1993

[87] PCT Pub. No.: WO91/18808

PCT Pub. Date: Dec. 12, 1991

Related U.S. Application Data

[63] Continuation of Ser. No. 938,176, Feb. 2, 1993, abandoned.

[30] Foreign Application Priority Data

Jun. 4, 1990 [AU] Australia ..... PK0484

[51] Int. Cl.[6] ..... B65D 83/04

[52] U.S. Cl. ..... 206/533; 206/536; 206/538; 206/528; 222/562

[58] Field of Search ..... 206/528, 533, 535, 536, 206/538, 539, 807, 540; 221/210, 309, 154; 222/562, 572

[56] References Cited

U.S. PATENT DOCUMENTS

| | | | |
|---|---|---|---|
| 2,236,224 | 3/1941 | Raschkind | 206/333 |
| 2,352,066 | 6/1944 | Apfelbaum | 206/536 |
| 2,695,115 | 11/1954 | Roop | 206/508 |
| 2,886,209 | 5/1959 | Lermer . | |
| 3,042,257 | 7/1962 | Dailey | 221/309 |
| 3,079,043 | 2/1963 | LeBlanc et al. | 221/265 |
| 3,446,339 | 5/1969 | Thompson | 206/533 |
| 3,678,884 | 7/1972 | Robbins | 206/539 |
| 3,863,804 | 2/1975 | Infante-Diaz et al. | 206/539 |
| 3,874,564 | 4/1975 | Huneke | 222/363 |
| 4,273,254 | 6/1981 | Cuppleditch et al. | 221/196 |
| 4,432,300 | 2/1984 | Lyss | 206/538 |
| 4,523,694 | 6/1985 | Veltri | 221/265 |
| 4,583,667 | 4/1986 | Fishman et al. | 206/538 |
| 4,792,054 | 12/1988 | Weidman | 222/23 |
| 4,971,203 | 11/1990 | Weinstein | 206/536 |
| 5,108,006 | 4/1992 | Tieke et al. | 221/4 |

FOREIGN PATENT DOCUMENTS

| | | | |
|---|---|---|---|
| 795644 | 10/1968 | Canada | 206/540 |
| 2396697 | 3/1979 | France | 206/540 |
| 2544611 | 10/1984 | France . | |

*Primary Examiner*—David T. Fidei

*Attorney, Agent, or Firm*—Nikaido, Marmelstein, Murray & Oram

[57] ABSTRACT

A dispensing container for containing a plurality of medical or food supplement tablets contained within the container in a random fashion and dispensing the tablets one at a time. The container has a hollow body and a first and second end, the first end is closed. The container is shaped internally at the second end to define an at least part circumferential channel bounded by sidewalls between which no relative movement occurs during dispensing. The channel is capable of permitting a number of randomly contained tablets to enter the channel in a preferred orientation. An aperture in the channel capable of permitting the tablets to leave said channel one at a time. A receptacle is disposed externally of the aperture and is capable of receiving a first tablets that has passed through the aperture and to hold the first tablet temporarily and permit its manual removal, as well as to cause the first tablet to block the way for any other such tablets from passing through the aperture until such time that the first tablet has been removed. An external means movable in relation to the body for opening and closing the aperture.

9 Claims, 9 Drawing Sheets

FIG. 11
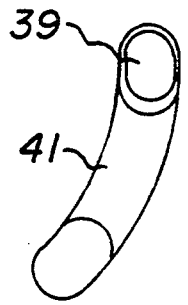
FIG. 9
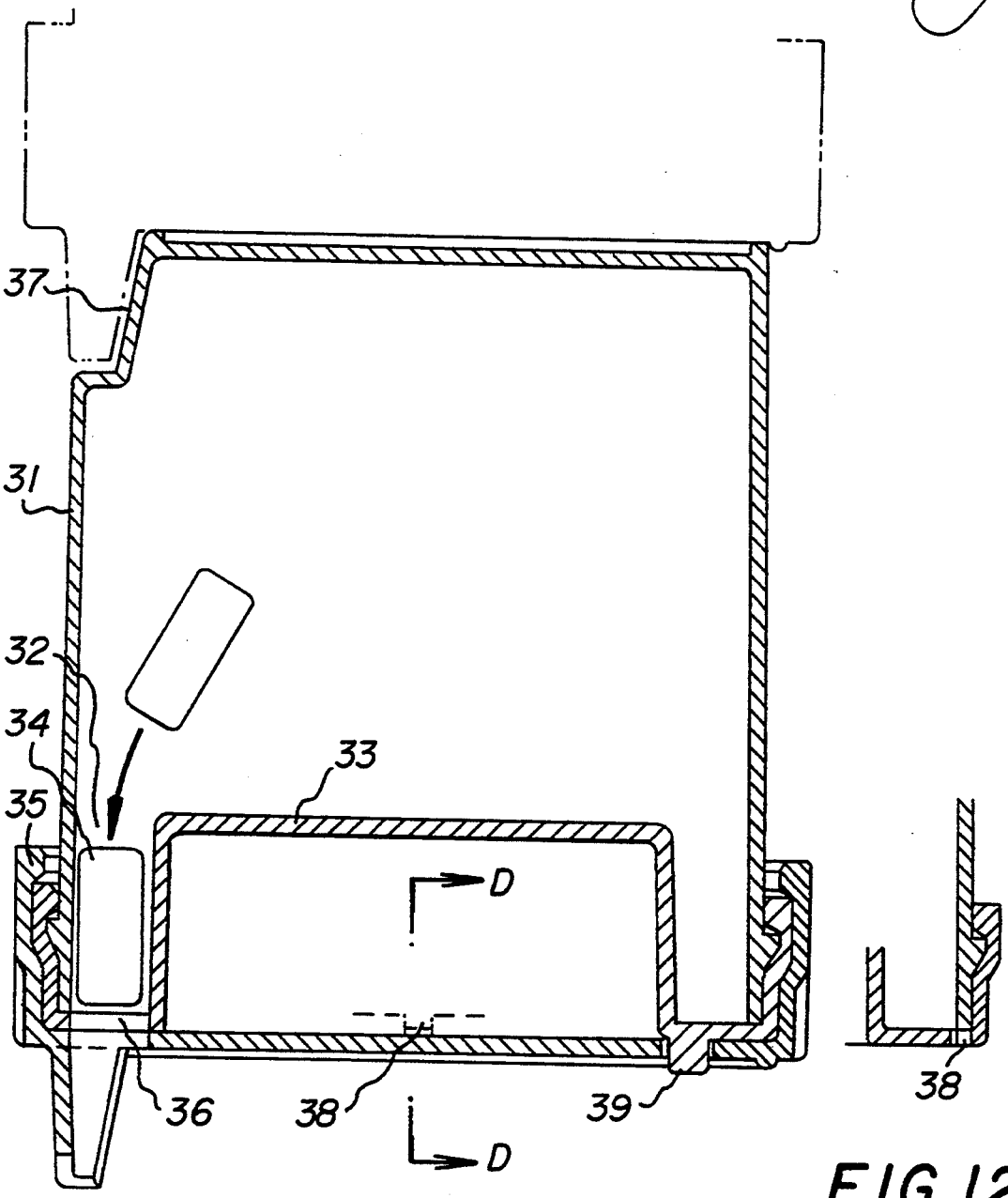
FIG. 12

FIG. 14a
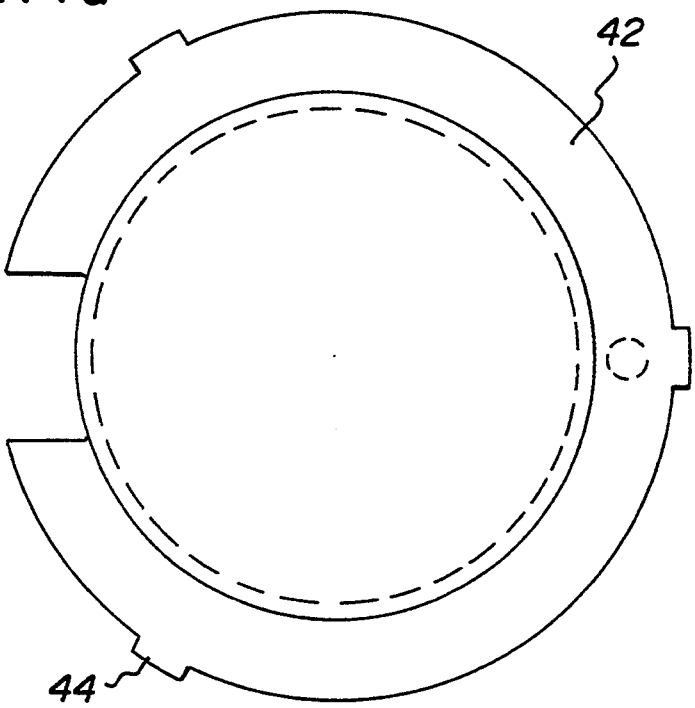
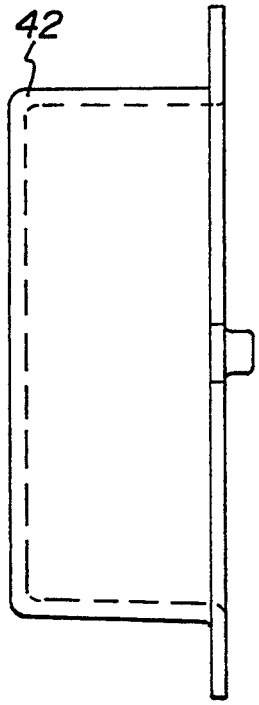
FIG. 14b
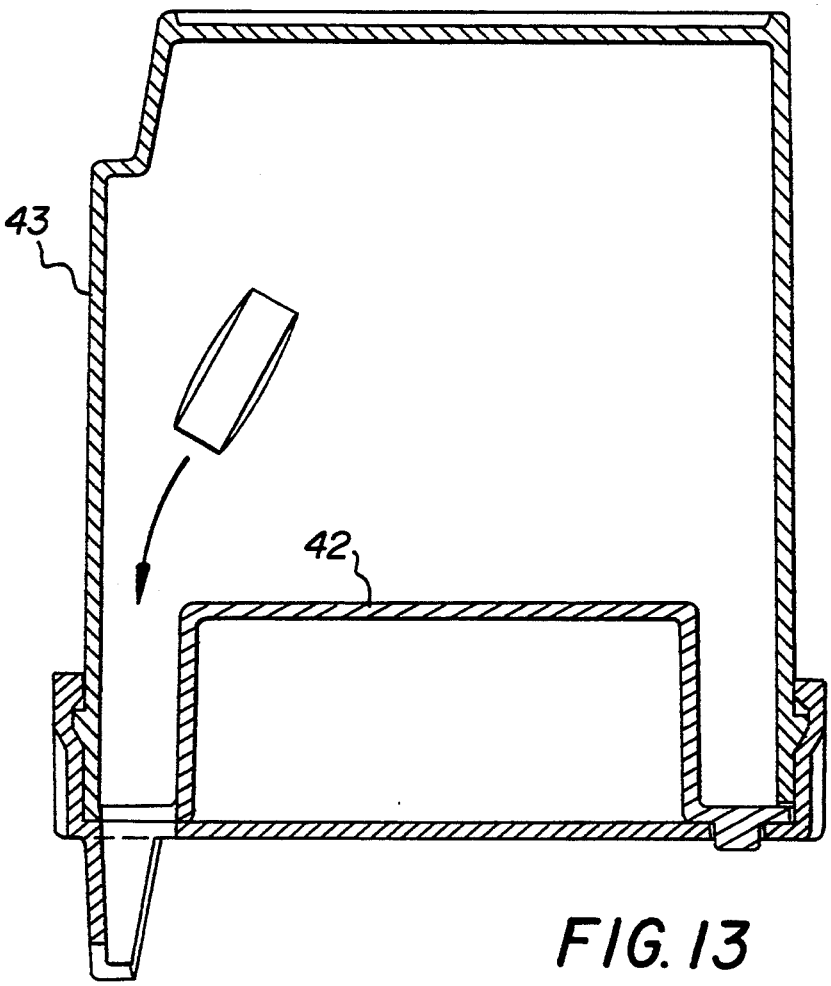
FIG. 13

DISPENSING CONTAINER FOR TABLETS

This application is a continuation of application Ser. No. 07/938,176, filed Feb. 2, 1993, now abandoned.

BACKGROUND OF INVENTION

There exist different plastic containers with push-on or threaded caps for medicinal tablets, sold in pharmacies, and for vitamin and mineral tablets, sold in health-food stores. In order to take a tablet or tablets out of one of these existing containers, the cap has to be removed and afterwards replaced, which is both cumbersome and unhygienic, exposing all of the tablets in that container to humidity and the possibility of bacterial contamination from outside.

The object of this invention is to provide a packaging container for tablets that will directionally orient the tablets inside the container, so that they can be conveniently dispensed, one at a time, through an aperture in the base or in the lid of the container, without having to remove the lid from the container and without having to expose all of the tablets in the container to the outside. Using this container is both more convenient and more hygienic.

SUMMARY OF INVENTION

The invention consists in a dispensing container for medicinal or food supplement tablets or other similarly shaped articles, the container having a hollow body closed at one end, the container being shaped internally at the other end to define an annular circumferential or part circumferential channel, the cross-sectional shape of which is such as to permit a number of said articles within the container to enter the channel in a preferred orientation, an aperture in the channel such as to permit said articles to leave the channel one at a time, a receptacle externally of said aperture to receive an article that has passed through the aperture to hold said article temporarily and permit its manual removal, as well as to make said article block the way for any other such articles from passing through said aperture until such time that said article has been removed, external means movable in relation to said body whereby said aperture may be opened or closed.

It is preferred that said external means shall consist in a cover at said one end rotatable in relation to said body to open or close said aperture, a pin projecting from said cover or said body through a slot in the other whereby the extent of movement of said cover is limited, said slot, when manufactured, including a portion closed by a thin frangible membrane that is destroyed by movement in relation to said pin on first movement of the cover to provide evidence of tampering with the sealed container.

BRIEF DESCRIPTION OF THE DRAWINGS

Without restricting the full scope of this invention, three preferred forms of this invention are illustrated in the following drawings:

FIG. 9 is a vertical section of a second preferred form of the invention, through the dispensing aperture and tamper-evident turning stop.

FIG. 11 is a view and section of the tamper-evident turning stop in the closed position.

FIG. 12 is the section D—D through the lid, container rim and key.

FIG. 13 is a vertical section of a third preferred form of the invention, through the dispensing aperture and turning stop.

FIGS. 14*a* and 14*b* are a plan and side view respectively of the annular channel insert of the third preferred form of the invention.

FIGS. 1, 2, 3 and 4 show a container without a tamper-evident feature, which is typical of most containers for medicinal tablets, sold over the counter in pharmacies.

FIGS. 5, 6 and 7, as well as FIGS. 9, 10 and 11 of the other preferred forms of the invention, show containers with tamper-evident features, which is preferred for most containers used for vitamin and mineral tablets, sold in self-service health-food stores.

DESCRIPTION OF THE PREFERRED EMBODIMENTS

Figure 1:
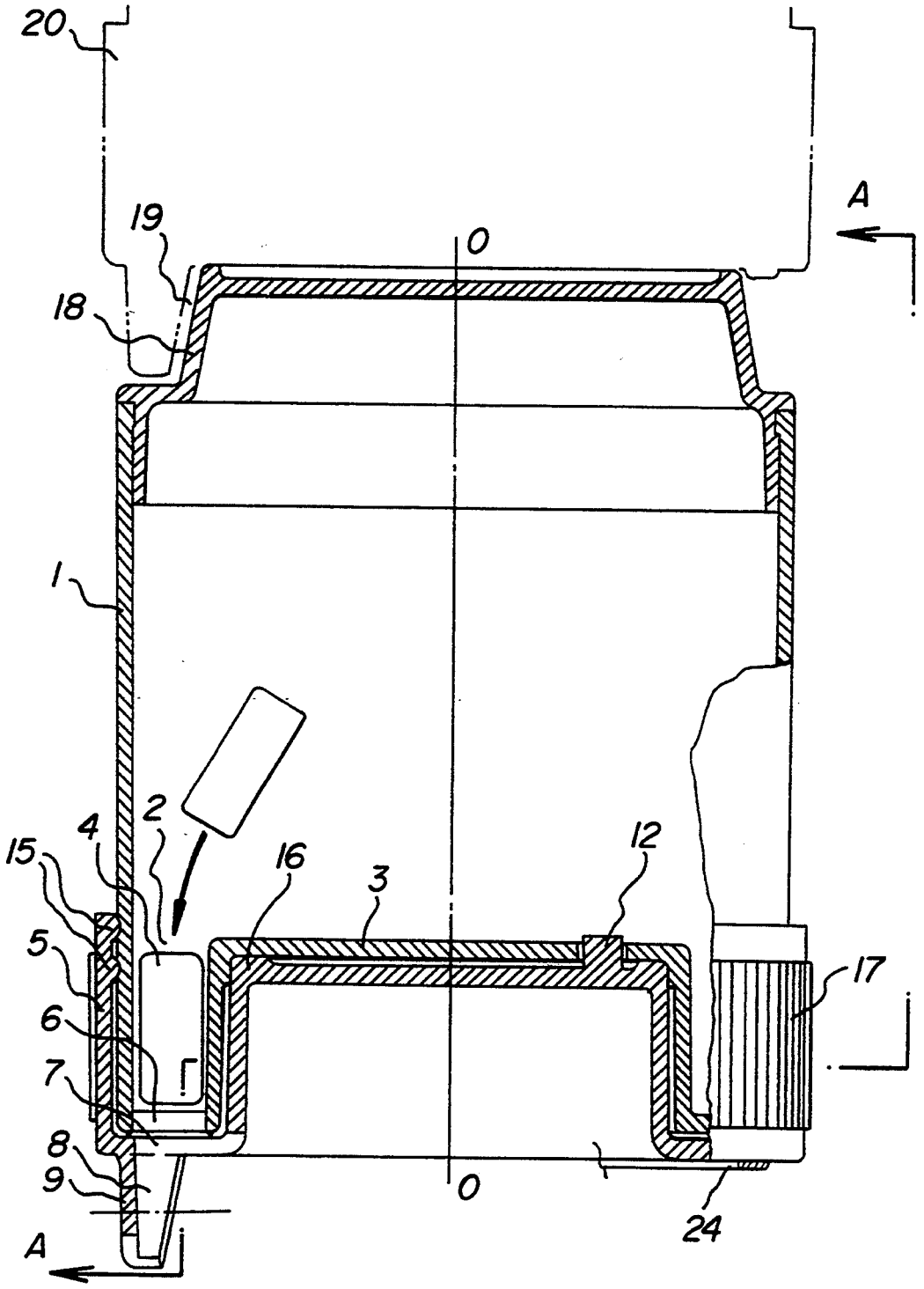
FIG. 1 is a vertical section of the container through the dispensing aperture and turning stop. It also shows the outline of a stacked second container.

The cylindrical container 1 in FIG. 1 has an annular channel 2 of rectangular cross-section formed around the perimeter of its base 3. The width of this channel 2 corresponds to the width of the tablet 4 and the depth of this channel is slightly greater than the diameter of the cylindrical tablet 4. The function of channel 2 is to orient directionally the tablet or tablets that drop into it, prior to being dispensed.

Figure 2:
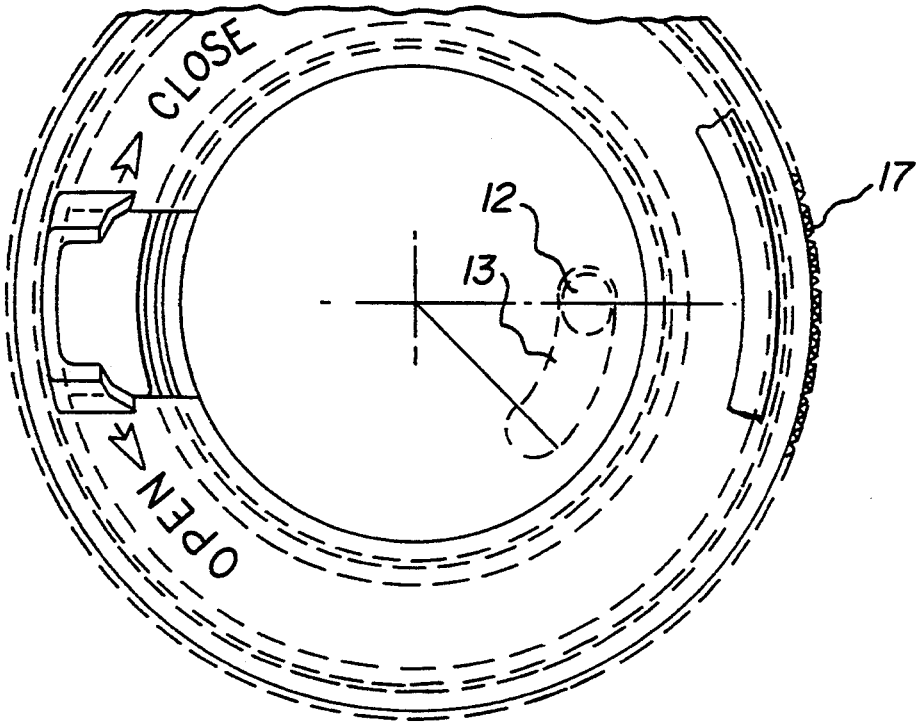
FIG. 2 is a view of the dispensing cover of the container in its open aperture position.
Figure 6:
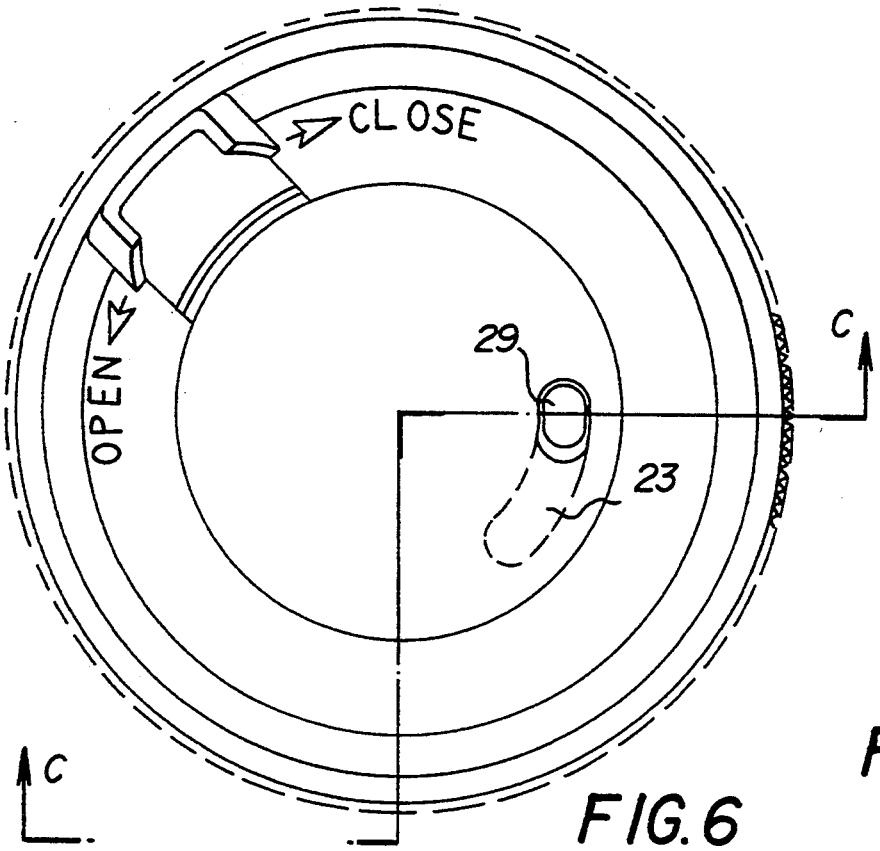
FIG. 6 is a view of the dispensing cover in its closed aperture position and the tamper-evident turning stop.

Attached to the base of the container 1 and closely following the outside profile of channel 2 is closure 5. In the base of channel 2 and closure 5 are the apertures 6 and 7 respectively, that are just large enough for a tablet to pass through when these two apertures are aligned. Closure 5 and base 3 have a common axis of rotation 0—0 and closure 5 can be displaced angularly in relation to base 3, so as to align the two apertures 7 and 6 and thereby allow tablets to pass through these apertures or, alternatively, misalign the two apertures 7 and 6 and thereby seal off the container. Pin 12 which is an integral part of closure 5 protrudes into the annular slot 13 in base 3 and the two extreme angular positions of said pin in relation to said slot provide the two stops—one for aligned apertures 7 and 6, as shown in FIG. 2, and the other for misaligned apertures, sealing off the container, as shown in FIG. 6.

Figure 3:
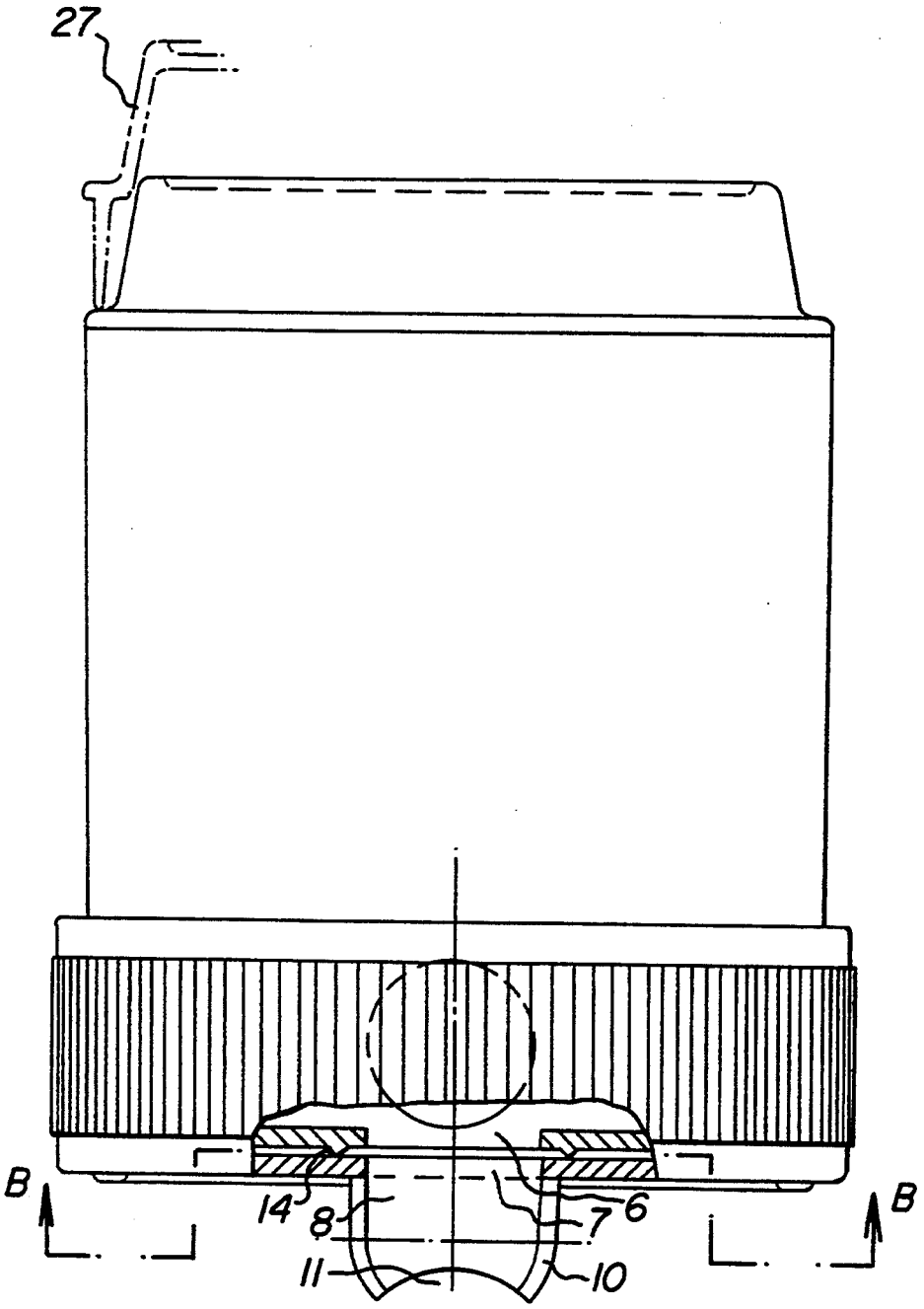
FIG. 3 is the side view A—A of the container with a vertical section through its dispensing aperture.

As shown in FIGS. 1 and 3, formed around aperture 7 of closure 5 is a tablet receptacle 8, consisting of a back wall 9 and two side walls 10. A tablet dropping through aperture 7 will be arrested in said receptacle and thereby block the way for any other tablets to drop through aperture 7. The semi-circular cut-out 11 in receptacle 8 facilitates access to the arrested tablet by providing clearance to the thumb and forefinger and enabling the user of this dispensing container to conveniently remove the dispensed tablet from the receptacle.

The container would normally rest on cap 18 with closure 5 at the top and apertures 6 and 7 sealed off. To dispense a tablet or tablets, the user will pick up the container; turn the closure 5 anti-clockwise until it is stopped by pin 12; turn the container upside-down; gently shake it, if necessary; remove the tablet from receptacle 8; turn the container right side up; turn closure 5 clockwise until it is stopped by pin 12; put the container down on its cap 18.

Figure 4:
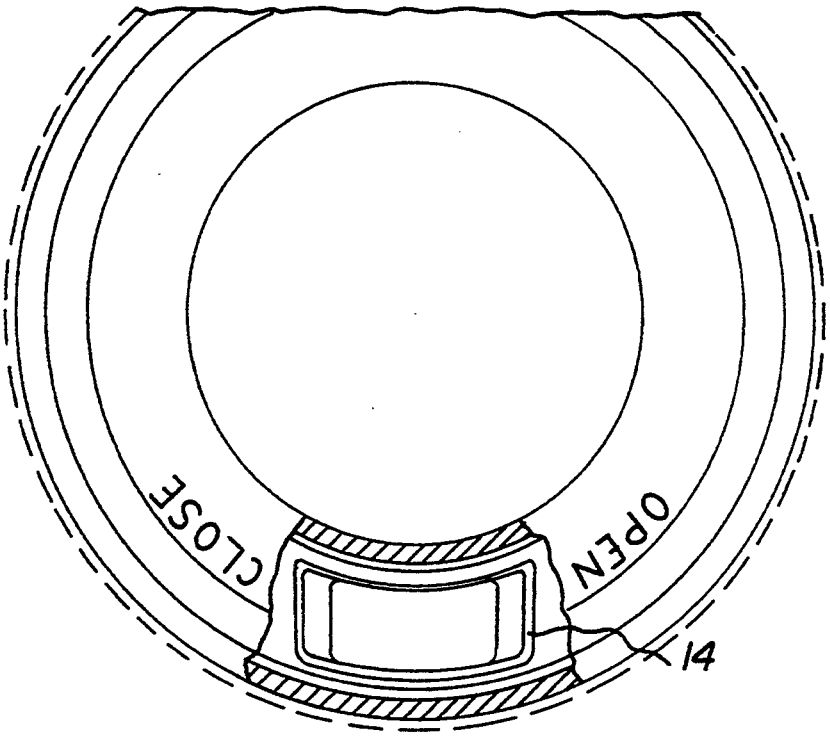
FIG. 4 is the view B—B of the dispensing cover with a horizontal section through its dispensing aperture.

Rib 14 around aperture 6 shown in FIGS. 4 and 3 is an integral part of container 1 and provides a seal with the mating internal surface of closure 5, thereby reducing the amount of external air and humidity that can enter into the container when apertures 7 and 6 are sealed off. Annular seals 15 and 16, shown in FIG. 1, which provide a close contact between closure 5 and container 1, perform a similar function of sealing off the external air and humidity. In addition, these annular seals 15 and 16 provide the necessary small amount of friction between closure 5 and container 1 to prevent unwanted rotation of one in relation to the other. Serrations 17, shown in FIGS. 1 and 2, on the outside of closure 5 facilitate the hand gripping action when turning closure 5 in relation to container 1.

The open end of container 1 is sealed off with a permanent cap 18 or, if necessary, can be closed off with a push-on or threaded cap that can be removed and replaced by the pharmacist or end-user.

Figure 8:
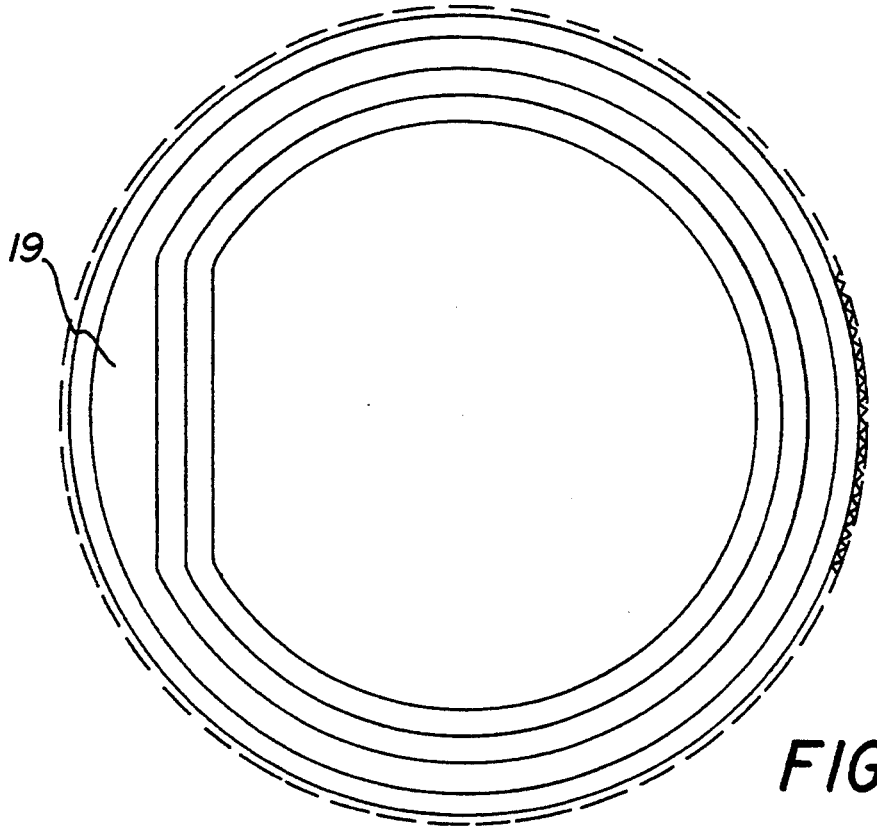
FIG. 8 is a view of the permanently closed cap of the container.
Figure 10:
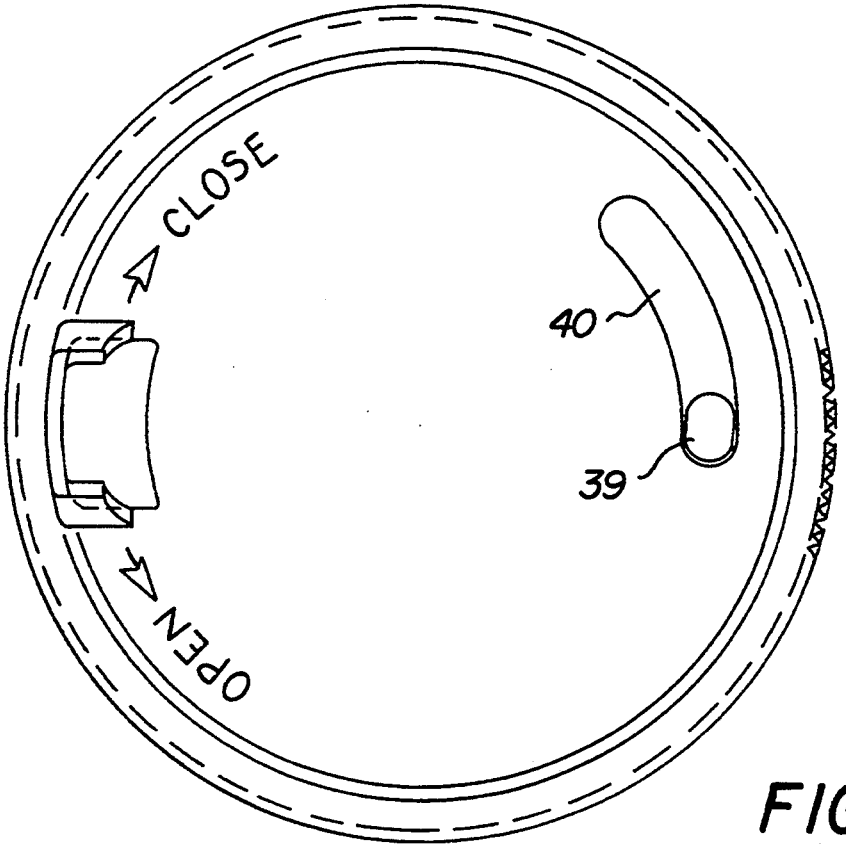
FIG. 10 is a view of the dispensing cover of the second preferred form of this invention in its open aperture position.
Figure 16A:
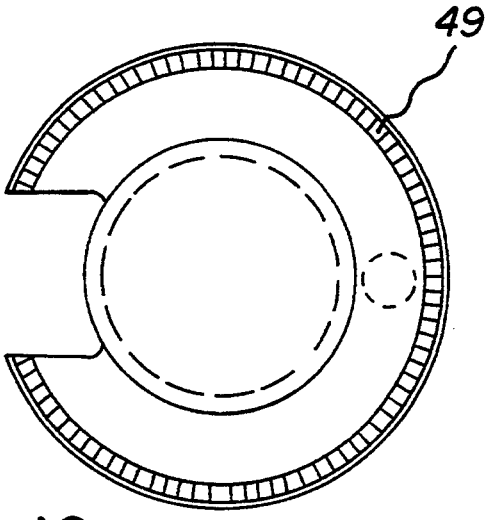
FIGS. 16*a* and 16*b* are a plan and side view respectively of the annular channel insert with serrations for location inside the container of FIG. 15.
Figure 16B:
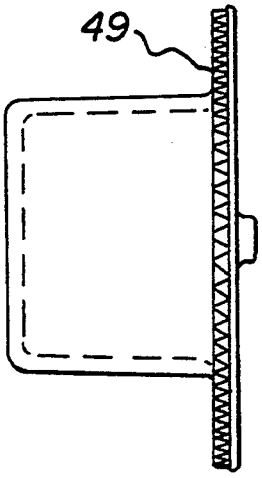

Cap 18 can be formed with a relief 19, as shown in FIGS. 1 and 8, in order to accommodate receptacle 8 when containers are stacked on top of each other during transport, storage or display on shelves. To further facilitate the stacking of containers, a shallow protrusion 24 is formed on the flat surface of closure 5, which follows the outer contour of cap 18 and locates the stacked containers in a coaxial position.

Figure 5:
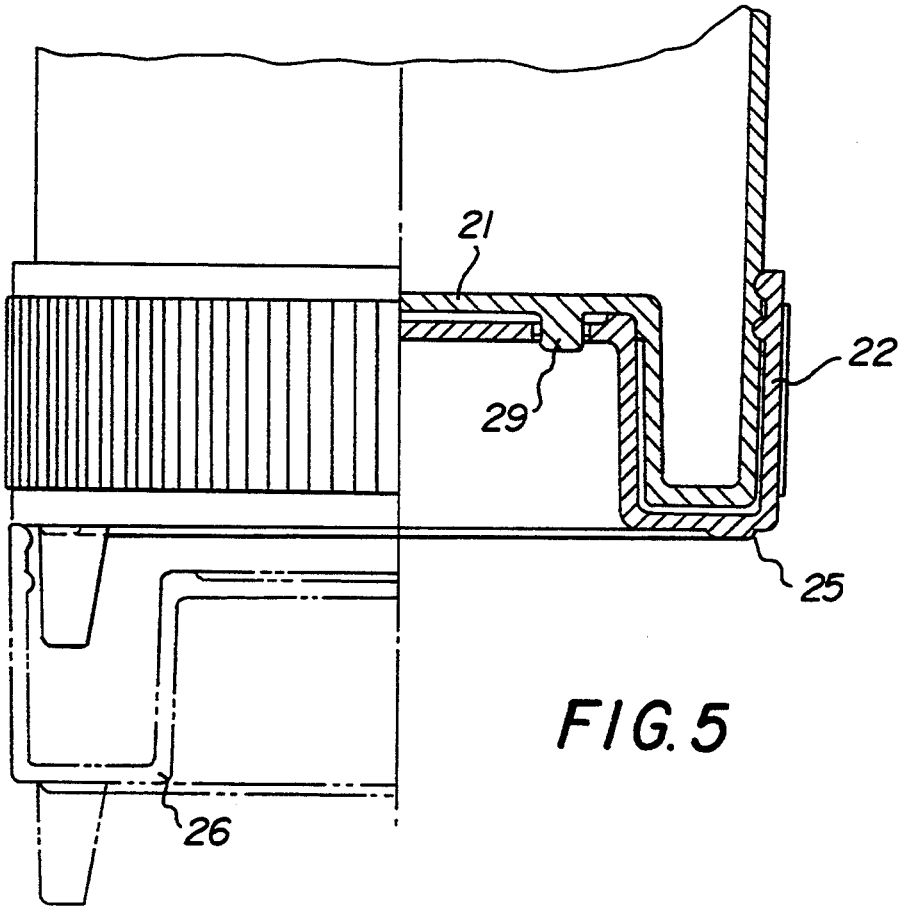
FIG. 5 is the side view C—C of the dispensing covers nested on top of each other and a vertical section through an alternative design of turning stop with tamper-evident membrane.

FIG. 5 shows how closure 26 will nest co-axially on top of other closures during manufacture, transport, storage and feeding in automatic capping machines of these closures, locating on the outside of the shallow protrusion 25.

FIG. 3 shows how cap 27 will nest co-axially on top of other caps during manufacture, transport, storage and feeding in automatic capping machines of these caps, due to the tapered side walls of the cap.

Figure 7:
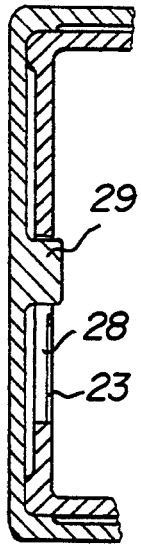
FIG. 7 is a vertical section through the tamper-evident turning stop in the closed aperture position with the tamper-evident membrane intact.

FIGS. 5, 6 and 7 show basically the same preferred form of the invention but with a tamper-evident membrane 23 where, contrary to the previous design, the pin 29 is an integral part of the base 21, protruding into an annular slot 28 in closure 22. The two extreme angular positions of said pin in relation to said slot provide the two stops—one for the open dispensing aperture and the other for the sealed aperture. FIG. 6 shows the stop position for the sealed aperture with the tamper-evident membrane 23 intact. The tamper-evident membrane 23 is an integral part of closure 22. When closure 22 is turned anti-clockwise in relation to the container for the first time, so as to open the dispensing aperture, pin 29 will tear the tamper-evident membrane 23.

FIGS. 9, 10, 11 and 12 show a second preferred form of this invention which differs from the previous preferred form in the following aspects:

1. Instead of the annular channel being formed in the base of the container, channel 32 is formed between the side wall of inverted container 31 and the recess wall of permanent lid 33.
2. Permanent closure 35 fits over lid 33, rather than over the base of the container.
3. The permanent cap of the previous preferred form is replaced by integral base 37 of container 31.
4. Dispensed tablet 34 drops through aperture 36 in lid 33, instead of an aperture in the container base.
5. Pin 39 is an integral part of lid 33 and the fixed angular position of lid 33 in relation to container 31 is secured by means of integral key or keys 38 in container 31 and corresponding rectangular holes in lid 33.
6. Tamper-evident membrane 41 is at the bottom of annular slot 40, rather than at the top, and it does not reach to the end of the slot, as it did in the previous preferred form of this invention, but stops before it reaches the open aperture position.

FIGS. 13 and **14*a* and 14*b*** show a third preferred form of this invention which differs from the second preferred form in the following aspect:

Lid 33 is replaced by annular channel insert 42 that is located inside the container 43 by means of three or more keys 44.

Figure 15:
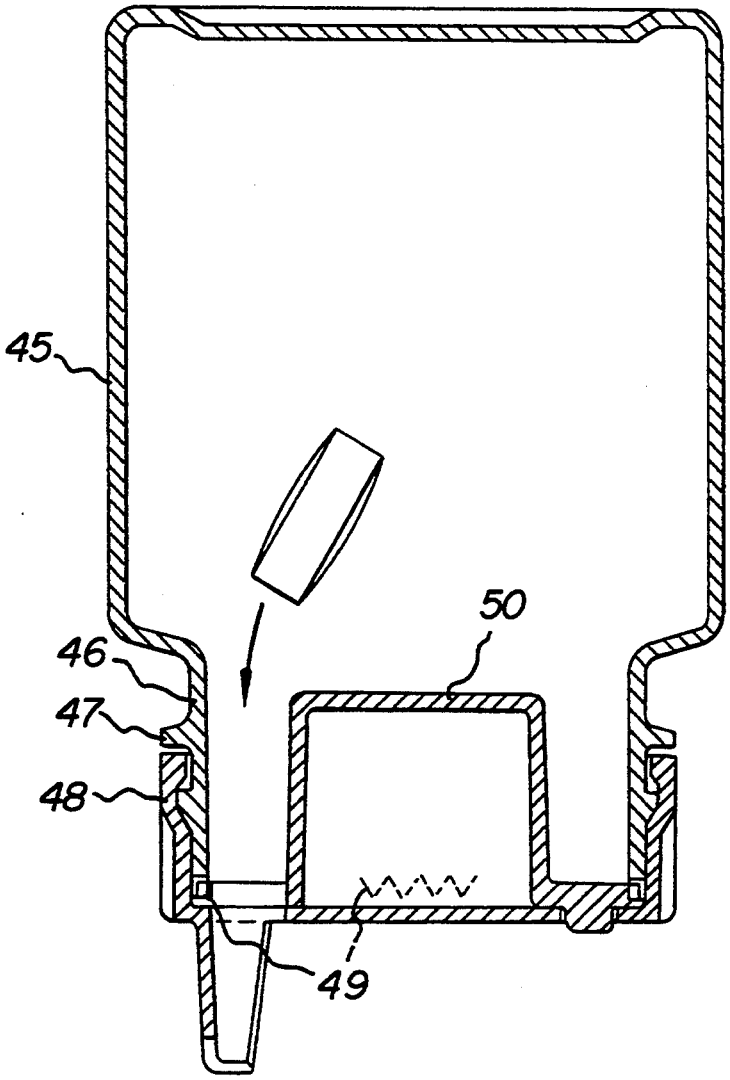
FIG. 15 is a vertical section of a bottle-shaped container, through the dispensing aperture and turning stop.
Figure 17A:
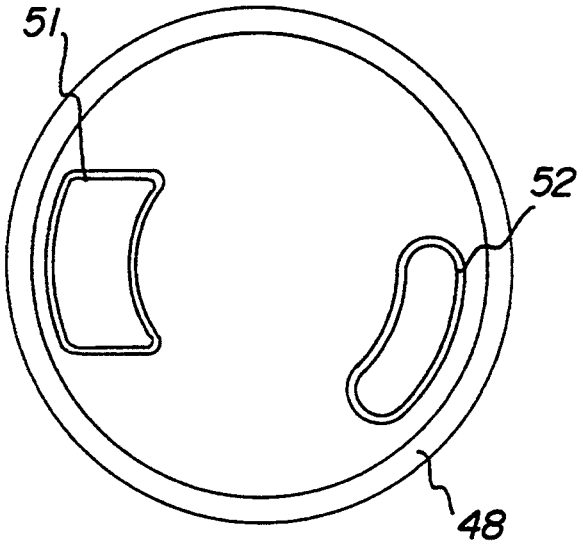
FIGS. 17*a* and 17*b* are a plan and side view respectively of a closure similar to that shown in FIGS. 9 and 15 but in which sealing ribs are provided around the dispensing aperture and the annular slot.
Figure 17B:
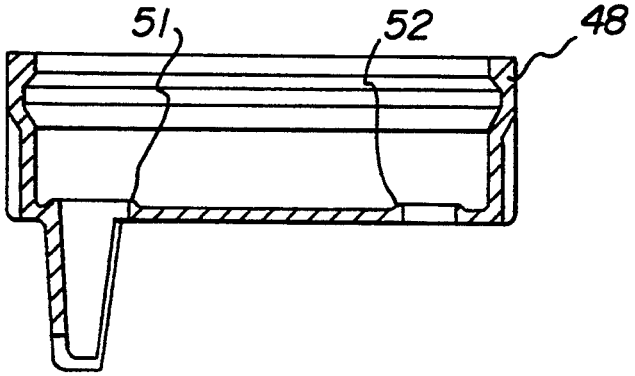

FIGS. 15 and **16*a* and 16*b* show serrations 49 replacing keys 44, this being of particular advantage when automatic filling and capping machines are being used, because these continuous serrations eliminate the need for angular alignment between the container and insert 50** when the capping device deposits the insert into the container.

FIGS. 15 and **16*a* and 16*b* also show the container 45 having the shape of a bottle, with its body narrowing towards the top, thereby forming a neck 46 smaller than the body. The neck 46 incorporates an external annular ring 47 which protects the tamper-evident closure 48** from being forcibly pried open.

The basic function of orienting and dispensing tablets in all three preferred forms of this invention is identical.

FIGS. **17*a* and 17*b* show a closure similar to closures 35 and 48 of FIGS. 9 and 15, respectively, in which circumferential ribs 51 and 52** are provided around the dispensing aperture and the annular slot to provide seals against the entry of external air and humidity.

Closures 5, 35 and 48 are all of the push-on type. In other embodiments of this invention the closures can be of the threaded type.

The abovementioned preferred forms of this invention show plastic moulding as the method of manufacture, however, other methods using materials such as glass and metal can also be used to manufacture the containers and closures.

I claim:

1. A dispensing container for containing a plurality of medical or food supplement tablets contained within the container in a random fashion and dispensing the tablets one at a time, comprising a container having a hollow body and a first and second end, said first end being closed, the container being shaped internally at said second end to define an at least part circumferential channel bounded by sidewalls between which no relative movement occurs, said channel being capable of permitting a number of randomly contained tablets to enter said channel in a preferred orientation, an aperture in said channel capable of permitting said tablets to leave said channel one at a time, an external closure, movable in relation to said body, to open and close said aperture, and a receptacle disposed externally of said aperture and being external of said container, said receptacle being capable of receiving a first tablet that has passed through said aperture to hold said first tablet temporarily and permit said first tablet's manual removal, as well as to cause said first tablet to block the way for a second such tablet from passing through said aperture until such time that said first tablet has been removed, and for receiving said second tablet upon removal of said first tablet without movement of said external closure, said receptacle forming part of said external closure, wherein said external closure is rotatable in relation to said body to open or close said aperture, a pin projecting from said second end through a slot in said external closure to limit the extent of movement of said external closure relative to said container, and a thin frangible membrane mounted in said slot in said external closure and capable of being destroyed on first movement of said external closure in relation to said pin in said second end to provide evidence of tampering with an initially sealed container, the only moving part of said dispensing container being said external closure.

2. A dispensing container for containing a plurality of medical or food supplement tablets contained within the container in a random fashion and dispensing the tablets one at a time, comprising a container having a hollow body and a first and second end, said first end being closed, the container being shaped internally at said second end to define an at least part circumferential channel bounded by sidewalls between which no relative movement occurs, said channel being defined between a wall of the container and an insert located within said second end of the container, said channel being capable of permitting a number of randomly contained tablets to enter said channel in a preferred orientation, an aperture in said channel capable of permitting said tablets to leave said channel one at a time, an external closure, moveable in relation to said body, to open and close said aperture, a receptacle disposed externally of said aperture and being external of said container, said receptacle forming part of said external closure and being capable of receiving a first tablet that has passed through said aperture to hold said first tablet temporarily and permit said first tablet's manual removal, as well as to cause said first tablet to block the way for a second such tablet from passing through said aperture until such time that said first tablet has been removed, and to receive said second tablet upon removal of said first tablet without movement of said external closure, and means for locating said insert within said container comprising continuous serrations so as to facilitate locating said insert within said container by automatic filling and capping machines, the only moving part of said dispensing container being said external closure.

3. A dispensing container for containing a plurality of medical or food supplement tablets within the container in a random fashion and dispensing the tablets one at a time, comprising a container having a hollow body and a first and second end, said first end being closed, said container having no moving parts therein and being shaped internally at said second end to define peripheral circular inner and outer walls defining an at least part circumferential channel therebetween, said inner and outer walls having concentric radii of curvature and having no relative movement therebetween, said circumferential channel generally defining said radii, said channel being capable of permitting a number of randomly contained tablets to enter said channel, said channel holding a plurality of said tablets each in a preferred, identical orientation with a centerline axis of each tablet oriented substantially along a radius of said circumferential channel and said container, an aperture in said channel permitting said tablets to leave said channel one at a time, a closure, movable in relation to said body, to open and close said aperture, and a receptacle forming part of said closure and disposed externally of said aperture, said hollow body and said second end, for receiving a first tablet that has passed through said aperture to hold said first tablet temporarily in a manually removable position, for causing said first tablet to block a second tablet from passing through said aperture until such time that said first tablet has been removed, and for receiving said second tablet upon removal of said first tablet without movement of said closure.

4. A dispensing container as claimed in claim 3, wherein said closure opening and closing said aperture comprises a cover located at said second end and rotatable in relation to said body to open or close said aperture, a pin projecting from said cover through a slot in said second end to limit the extent of rotational movement of said cover relative to said container.

5. A dispensing container as claimed in claim 3, wherein said closure opening and closing said aperture comprises a cover located at said second end and rotatable in relation to said body to open or close said aperture, a pin projecting from said second end through a slot in said cover to limit the extent of rotational movement of said cover relative to said container.

6. A dispensing container as claimed in claim 3, wherein said container is a bottle with a neck end, said aperture being formed in the neck end of the bottle.

7. A dispensing container as claimed in claim 3, wherein said channel is defined between a wall of the container and an insert located within said second end of the container.

8. A dispensing container as claimed in claim 7, further including means comprising keys for locating said insert within said container.

9. A dispensing container for containing a plurality of medical or food supplement tablets within the container in a random fashion, and dispensing the tablets one at a time comprising a container having a hollow body and a first and second end, said container having no moving parts therein, said first end being closed and generally defining a first plane, said second end generally defining a second plane, an at least part circumferential channel which orients a plurality of said tablets in said hollow body in a preferred orientation, the oriented tablets being located in substantially the same plane which plane is substantially parallel to said first and second planes, said channel being disposed in said second end and defined between spaced peripheral circular sidewalls, said sidewalls having no relative movement therebetween, an aperture in said channel for permitting said tablets to leave said channel one at a time, a closure movable in relation to said hollow body to open and close said aperture, and a receptacle forming part of said closure disposed externally to said aperture for receiving a first tablet that has passed through said aperture, for holding said first tablet temporarily and for permitting manual removal of said first tablet, for causing said first tablet to block the way for another, second tablet from passing through said aperture until such time that said first tablet has been removed, and for receiving said second tablet, without movement of the said closure, after removal of said first tablet, said receptacle being disposed externally of said hollow body.

* * * * *